US005517202A

United States Patent [19]

Patel et al.

[11] Patent Number: 5,517,202

[45] Date of Patent: May 14, 1996

[54] MINIMAL WASHOVER, INLINE HIGH FREQUENCY BUOYANT ANTENNA

[75] Inventors: Jayant S. Patel, Waterford; Rolf G. Kasper, Old Lyme; Craig A. Wagner, Norwich; Anthony J. Kalinowski, East Lyme, all of Conn.

[73] Assignee: The United States of America as represented by the Secretary of the Navy, Washington, D.C.

[21] Appl. No.: 366,933

[22] Filed: Dec. 30, 1994

[51] Int. Cl.[6] ..... H01Q 1/34

[52] U.S. Cl. ..... 343/709; 340/984; 441/11

[58] Field of Search ..... 343/709, 710; 367/3, 4; 441/30, 11, 33; 340/984, 985, 870.1; 114/242, 312, 313; H01Q 1/34

[56] References Cited

U.S. PATENT DOCUMENTS

| | | | |
|---|---|---|---|
| 2,448,713 | 9/1948 | Hansell | 343/709 |
| 3,599,213 | 10/1971 | Fessenden et al. | 343/710 |
| 4,376,941 | 3/1983 | Zenel | 343/709 |
| 4,675,686 | 6/1987 | Robinson et al. | 343/709 |
| 4,962,488 | 10/1990 | Dell-Imagine et al. | 343/709 |

*Primary Examiner*—Donald T. Hajec
*Assistant Examiner*—Tan Ho
*Attorney, Agent, or Firm*—Michael J. McGowan; Prithvi C. Lall; Michael F. Oglo

[57] ABSTRACT

A buoyant antenna for providing sufficient transmission time windows for communication at ultra-high and extremely-high frequencies. The antenna is configured to float on the surface of a body of water and is connected to a vessel through a communications cable. The buoyant antenna has a length and a stabile or rotation resistant cross-section which minimizes wash over when deployed in a manner which essentially eliminates in line tension on the antenna. The antenna is cylindrically shaped with sensor elements offset from the centerline. A high density mass is placed diametrically opposite the sensor elements and a high buoyancy foam fills out the remaining cylindrical shape. The high density mass creates a righting moment to maintain the sensor elements above the water line. The absence of in line tension during communication periods serves also to eliminate any detectable wake during those communication periods. The lack of detectability makes the antenna and its deployment method particularly well suited for use when the vessel is a submarine.

12 Claims, 2 Drawing Sheets

MINIMAL WASHOVER, INLINE HIGH FREQUENCY BUOYANT ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to buoyant cable antennas and more particularly to a means for providing sufficient transmission time windows for communication at ultra-high and extremely-high frequencies with an underwater or undersea object in sea state 2. The cable antenna is configured to minimize washover effects and is deployed in a manner to minimize in-line tension on the cable/antenna interface.

(2) Description of the Prior Art

Buoyant antenna systems are well known means for providing communication with an underwater or undersea vehicle. Typically, the buoyant antenna is released from the vehicle and floats to the water surface. For proper communication, the antenna must ride at a sufficient height above the water surface. Various flotation methods are used to insure adequate height including surrounding the conductor with a lightweight insulation material as in Pierce (U.S. Pat. No. 2,048,811) or having a hollow cross-section as in Tennyson (U.S. Pat. No. 3,068,477). Wave interaction with such antennas, especially in sea state 2 or greater, causes water to wash over the antenna surface with consequent signal degradation. When used in conjunction with a submarine seeking to remain undetected by the enemy, the design of such antenna systems must also take into account the method of deploying the antenna. Current antennas are towed behind the submarine and wakes caused by the antenna have presented detectability problems.

SUMMARY OF THE INVENTION

Accordingly, it is a general purpose and object of the present invention to provide a buoyant antenna means for minimizing the amount of wash over.

It is a further object that such buoyant antenna means maximize the height of the conductive antenna element of the system above the water surface.

Another object is that such buoyant antenna means have a stabile cross-section to minimize rotation of the antenna means.

Still another object is that the method of deploying such buoyant antenna means minimize the wake of such antenna means.

A still further object is that the method of deploying such buoyant antenna means minimize in-line tension on the buoyant antenna means.

These objects are accomplished with the present invention by providing a buoyant antenna means having built in rotational stability. When used in conjunction with a moving underwater vehicle such as a submarine, the antenna cable payout rate is such that the buoyant antenna means may float on the water surface without tension from the antenna cable. One embodiment comprises an antenna means having a cylindrical cross-section with an outer jacket material providing adequate strength to withstand deployment, sea state and retrieval forces, having minimal radar cross-section (RCS) vulnerability and salt water and salt mitigating properties. The antenna conductor element is offset from the centerline of the antenna means and a high density mass is also offset from the centerline, diametrically opposed from the conductor element. The remainder of the cylindrical cross-section within the outer jacket is comprised of buoyant foam material.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
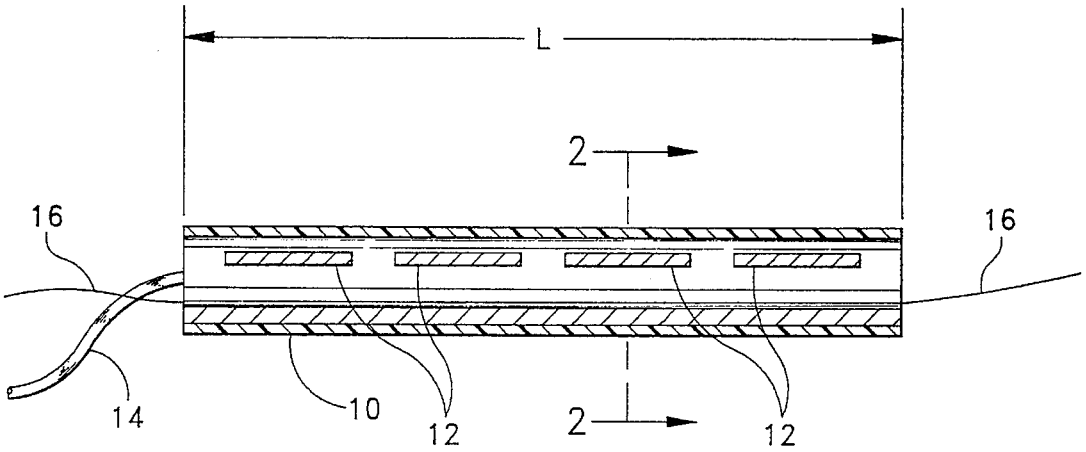
FIG. 1 shows a longitudinal cross-section of the buoyant antenna means.

Referring now to FIG. 1, there is shown a longitudinal cross section of buoyant antenna means 10. Antenna means 10 is a fairly rigid elastic cylinder and comprises sensor elements 12 for receiving and transmitting electromagnetic energy. Antenna means 10 is flexible enough to allow minimal bending during wave action, thus maintaining a greater portion of antenna means 10 above the surface when compared to a fully rigid cylinder. 0n the other hand, antenna means 10 is made stiff enough to maintain sensor elements 12 in general alignment for improved communications. The number and length of sensor elements 12 will depend upon the electromagnetic energy frequencies of interest. Cable 14 connects antenna means 10 to a vessel (not shown). In a sea water environment, the length L of antenna means 10 is based on mathematical analysis of sea surface physics using well known methods including the Pierson-Moskowitz energy spectrum (W. J. Pierson, Jr. and L. Moskowitz, "A Proposed Spectral Form for Fully Developed Wind Seas Based on the Similarity Theory of S. A. Kitaigovodskii", *Journal of Geophysics Research* 69, 5181–5190 1964) and multiple term cosine series. The wave heights, wave periods and wavelengths determined by various harmonic distributions defined by the Pierson-Moskowitz energy spectrum and a thirty term cosine series, are such that washover is minimal when L is less than fifteen feet, provided antenna means 10 has the proper buoyancy design and in-line tension from cable 14 is negligible. The buoyancy of antenna means 10 is designed to maintain sensor elements 12 at the maximum height above water surface 16. Additionally, antenna means 10 design must also provide a righting moment to counteract any twisting of antenna means 10 caused by wave action. Such wave action would tend to rotate antenna means 10 such that sensor elements 12 would be below water surface 16. The righting moment is designed to bring sensor elements back to the highest point above water surface 16.

Figure 2:
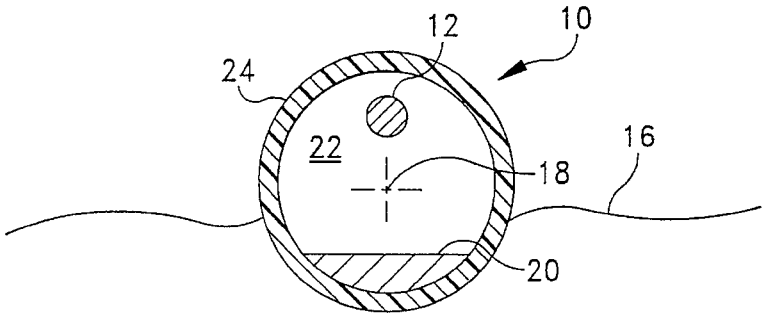
FIG. 2 shows a transverse cross-section of the buoyant antenna means taken at 2—2 of FIG. 1.

Referring additionally to FIG. 2, there is shown a transverse cross-section of antenna means 10 taken at 2—2 of FIG. 1. Sensor element 12 is shown offset from centerline 18 of cylindrical antenna means 10. High density mass 20 is also offset from centerline 18 and diametrically opposed to sensor element 12. Buoyant foam 22 surrounds sensor element 12 and abuts high density mass 20, and together with high density mass 20 forms the cylindrical shape of antenna means 10. The buoyancy of foam 22 is such that antenna means 10 floats at water surface 16 with centerline 18 above water surface 16. High density mass 20 provides a righting moment to antenna means 10 to maintain sensor element 12 above water surface 16. Outer jacket 24 surrounds foam 22 and mass 20 and is fabricated of a material, such as reinforced polyethylene, polypropylene, or other non-water absorbing polymer. Outer jacket 24 maintains antenna means 10 fairly rigid, provides mitigation against salt, water and salt intrusion and reduces RCS vulnerability. The design of antenna means 10 as described provides the proper buoyancy design for minimizing wash over as referred to previously.

Figure 3:
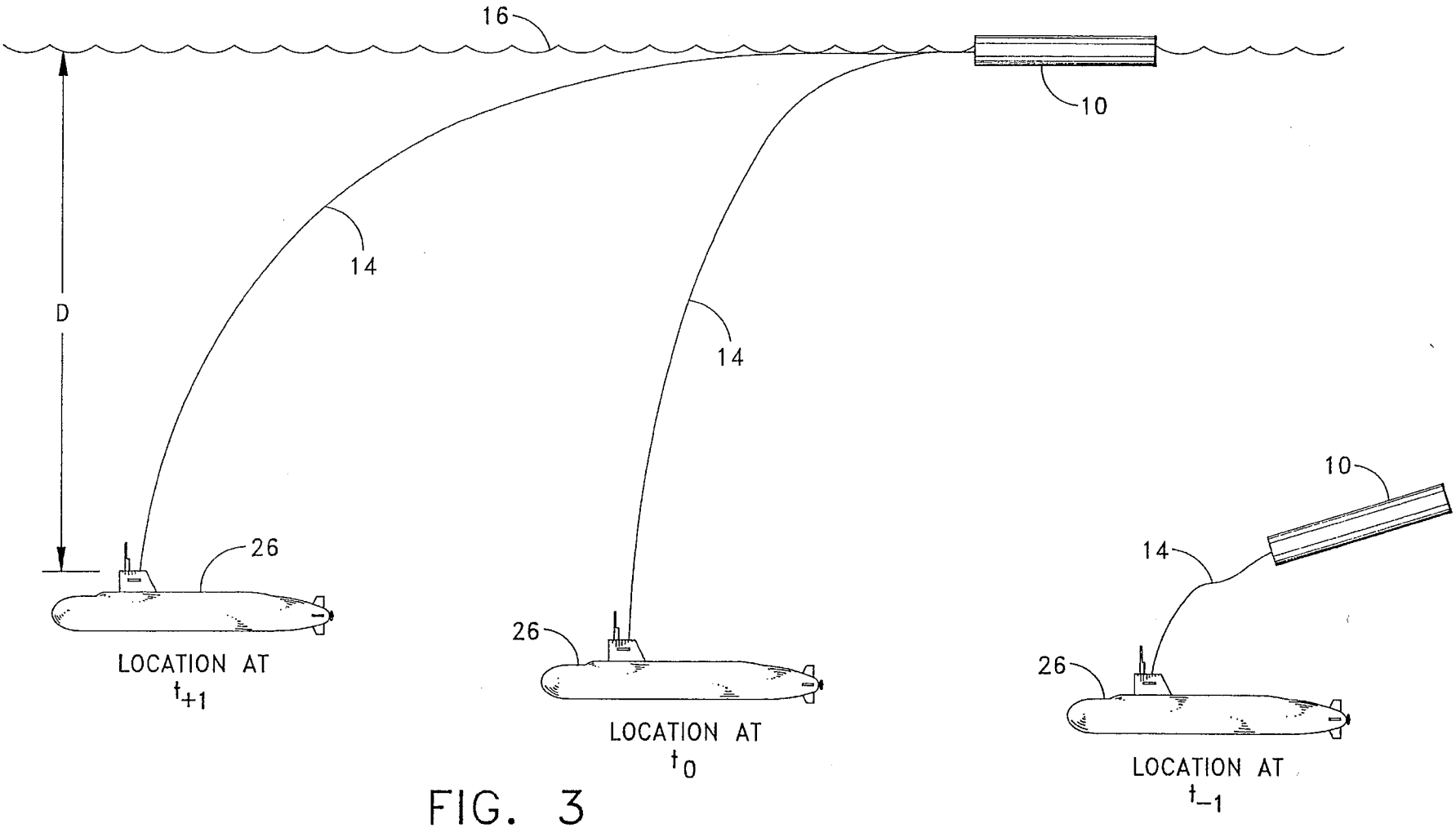
FIG. 3 is a schematic representation of a method for deploying the buoyant antenna means.

Referring now to FIG. 3, there is shown a schematic representation of a method of deploying antenna means 10 from a submerged vessel 26, such as a submarine. At a time $t_{-1}$ prior to the desired receipt or transmission of electromagnetic energy, antenna means 10 is released from vessel 26 and begins to float upwards to water surface 16. Cable 14 has one end attached to antenna means 10 and the other end attached to vessel 26. In the preferred embodiment, cable 14 is an electromechanical cable having sufficient strength to resist the release and retrieval forces it is subjected to and further having a conductive element for conveying signals received by antenna means 10 to vessel 26. At time $t_0$ when the communication is to take place, antenna means 10 has reached surface 16 and is floating thereon in the configuration illustrated in FIG. 1.

The length of cable 14 released from vessel 26 in the time period between $t_{-1}$ and $t_0$ is determined by the depth D at which antenna means 10 is released, the speed of vessel 26 and the buoyancy properties of cable 14, the length being such that cable 14 does not exert any tension on antenna means 10. In the preferred embodiment, cable 14 is slightly positively buoyant such that no downward force is exerted on antenna means 10 by cable 14 when antenna means 10 is in the floating configuration. The time period ($t_0$ minus $t_{-1}$) required for antenna means 10 to reach surface 16 is shortest when cable 14 is positively buoyant. As vessel 26 continues moving, additional cable is released such that antenna means 10 remains in approximately the same position at water surface 16 and the movement of vessel 26 does not cause cable 14 to apply any tension on antenna means 10. At time $t_{+1}$, when communications have been completed, cable 14 and antenna means 10 are retrieved back into vessel 26. The negligible in-line tension imposed on antenna means 10 by the use of the described deployment method meets the requirements referred to previously to minimize wash over.

Figure 4:
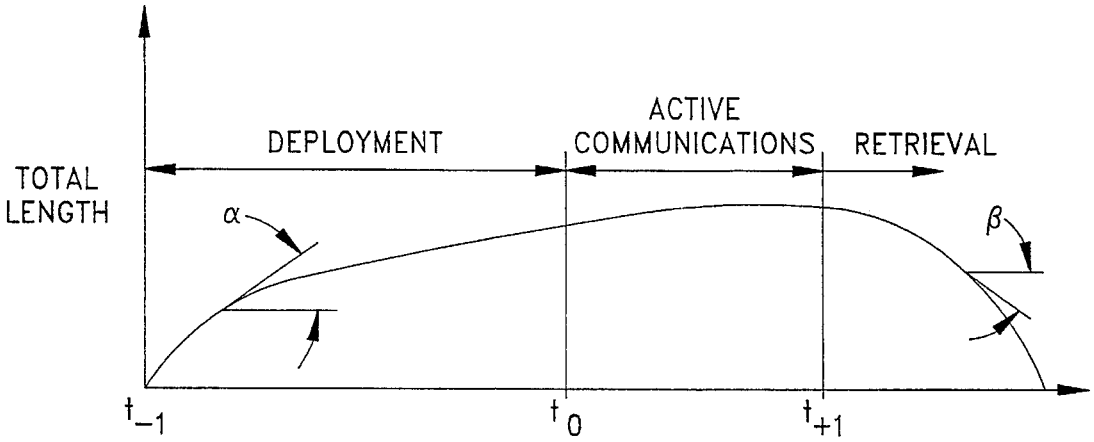
FIG. 4 is a graphical representation of the payout length of the method of FIG. 3 as a function of time.

Referring now additionally to FIG. 4, there is shown a graphical representation of the payout length of cable 14 as a function of time. The initial rate at which cable 14 is released (indicated by angle $\alpha$) is determined by the speed and depth of vessel 26 and the desired time period between initial release and first communication ($t_0$ minus $t_{31\ 1}$). Once antenna means 10 reaches surface 16, the rate of cable 14 release is such that movement of vessel 26 does not cause antenna means 10 to move over surface 16. Cable release is continued until communication is completed. Cable 14 retrieval rate (indicated by angle $\beta$) is shown as increasing over time which would be the case where the retrieval method comprises winding cable 14 onto a drum.

The advantages of the present invention over the prior art are that antenna means 10 of the present invention provides improved communications by minimizing the amount of water washed over antenna means 10 in sea state 2 or greater. It is well known that signal strength for UHF and EHF communications degrades rapidly in water, especially sea water. By minimizing both the amount of sea water washing over antenna means 10 and the frequency of sea water wash over as compared to prior art antennas, signal degradation caused by wash over is lessened and communications are enhanced. Further, the method of deploying antenna means 10 allows antenna means 10 to remain at the same location at water surface 16 during communication. Optimum signal strength may be directed at this fixed location rather than tracking a moving antenna, thus further improving communications. Additionally, the lack of towing movement of antenna means 10 eliminates any wake caused by towing an antenna and lessens the possibility of radar, infrared and visual detection.

What has thus been described is a buoyant antenna means having a length and a stabile or rotation resistant cross-section which minimizes wash over when deployed in a manner which essentially eliminates in line tension on the antenna means. The absence of in line tension during communication periods serves also to eliminate any detectable wake during those communication periods. The lack of detectability makes the antenna means and its deployment method particularly well suited for use in a submarine.

Obviously many modifications and variations of the present invention may become apparent in light of the above teachings. For example, various materials and configurations may be used to provide the proper buoyancy design for antenna means 10. In addition, the release and retrieval rates used to deploy antenna means 10 can be varied to suit the operating parameters of vessel 26. Antenna means can also be deployed from a stationary vessel such as a life raft. In this case, antenna means 10 may be stowed in a collapsed state, without the buoyant foam, to conserve space. For deployment, a compressed foam could be expanded into the collapsed cylinder which would harden to provide a fairly rigid antenna of the proper length.

In light of the above, it is therefore understood that within the scope of the appended claims, the invention may be practiced otherwise than as specifically described.

What is claimed is:

1. A buoyant antenna for electromagnetic signal communication with a vessel comprising:

an elongated, generally cylindrical body having a positive buoyancy for floating on a water surface, the body having a longitudinal axis;

at least one sensor disposed within the body in spaced relation to the longitudinal axis of the cylindrical body, the at least one sensor transmitting and receiving the electromagnetic signal communication; and a weighted portion disposed within the body diametrically opposite the at least one sensor, the weighted portion providing a righting force to the body, the force tending to maintain the at least one sensor and the weighted portion in vertical alignment, the positive buoyancy tending to maintain the sensor above the water surface.

2. The buoyant antenna of claim 1 wherein the body further comprises:

an inner core for providing the positive buoyancy, the inner core surrounding the at least one sensor and abutting the weighted portion, the inner core being essentially transparent to the electromagnetic signal communication; and an outer layer forming an exterior surface of the cylindrical body, the outer layer preventing water from entering the body, the outer layer being essentially transparent to the electromagnetic communication.

3. The buoyant antenna of claim 2 further comprising a cable disposed between the body and the vessel, the cable having a first end and a second end, the first end being connected to the at least one sensor, the second end connected to the vessel, for transmitting the electromagnetic signal communication between the vessel and the sensor.

4. The buoyant antenna of claim 3 wherein said cable is positively buoyant.

5. The buoyant antenna of claim 4 wherein said outer layer is a water resistant polymer selected from the group consisting of reinforced polyethylene and polypropylene.

6. The buoyant antenna of claim 1 further comprising a cable disposed between the body and the vessel, the cable having a first end and a second end, the first end being connected to the at least one sensor, the second end connected to the vessel, for transmitting the electromagnetic signal communication between the vessel and the sensor.

7. The buoyant antenna of claim 1 wherein the elongated body has a length of less than fifteen feet, the length minimizing a time period when the sensor is below the water surface due to a wave action at the water surface.

8. A buoyant antenna system for electromagnetic signal communication with a submarine submerged beneath a water surface, the system comprising:

an elongated outer casing in the shape of an open cylinder having a longitudinal axis;

at least one sensor disposed within the casing in spaced relation to the longitudinal axis of the cylindrical casing, the at least one sensor transmitting and receiving the electromagnetic signal communication;

a weighted mass disposed within the outer casing in a diametrically opposite spaced apart relation to the sensor, the weighted mass being negatively buoyant;

a positively buoyant body core disposed within the casing, the core surrounding the sensor and abutting the weighted mass, the body core having a buoyancy sufficient to provide the casing, sensor, weighted mass and body core combination with a positive buoyancy, the buoyancy sufficient to raise the sensor above the water surface, the weighted mass being below the water surface, the weighted mass providing a righting force tending to maintain the sensor and the weighted mass in vertical alignment;

a communications cable for electromagnetically connecting the sensor to the submarine.

9. The buoyant antenna of claim 8 wherein the outer casing has a length of less than fifteen feet, the length minimizing a time period when the sensor is below the water surface due to a wave action at the water surface.

10. The buoyant antenna system of claim 9 wherein the outer casing is a water resistant polymer selected from the group consisting of reinforced polyethylene and polypropylene.

11. The buoyant antenna system of claim 10 wherein the communications cable is positively buoyant.

12. A method for reducing a wake formed in deploying from a vessel submerged below a water surface a buoyant antenna system comprising an elongated outer casing in the shape of an open cylinder having a longitudinal axis, at least one sensor disposed within the casing in spaced relation to the longitudinal axis of the cylindrical casing, a negatively buoyant weighted mass disposed within the outer casing in a diametrically opposite spaced apart relation to the sensor, a positively buoyant body core disposed within the casing, the core surrounding the sensor and abutting the weighted mass, the body core having a buoyancy sufficient to provide the casing, sensor, weighted mass and body core combination with a positive buoyancy, the buoyancy sufficient to raise the sensor above the water surface when the outer casing is floating on the water surface, the weighted mass being below the water surface, the weighted mass providing a righting force tending to maintain the sensor and the weighted mass in vertical alignment when the outer casing is floating on the water surface, the at least one sensor transmitting and receiving electromagnetic signal communication with the submerged vessel through a positively buoyant communications cable electromagnetically connected between the sensor and the submerged vessel, the cable being stored in a reeled configuration aboard the submerged vessel prior to deployment, the antenna system being attached to the submerged vessel prior to deployment, the method comprising the steps of:

releasing the antenna system from the submerged vessel, the antenna system tending to rise to the water surface;

unreeling a sufficient length of the cable from the submerged vessel to allow the antenna system to reach the water surface; and continuing to unreel the cable when the antenna system has reached the water surface, the cable being unreeled at a rate sufficient to prevent a movement of the submerged vessel from causing a corresponding movement of the antenna system over the water surface, the lack of corresponding antenna system movement reducing the wake formed by the antenna system as it floats on the water surface.

* * * * *